US005707037A

United States Patent [19]

Pastrick

[11] Patent Number: 5,707,037

[45] Date of Patent: Jan. 13, 1998

[54] TREE STAND

[75] Inventor: John J. Pastrick, University Heights, Ohio

[73] Assignee: County Line Limited, L.L.C., Warrensville Heights, Ohio

[21] Appl. No.: 577,887

[22] Filed: Dec. 22, 1995

[51] Int. Cl.[6] ..... F16M 13/00

[52] U.S. Cl. ..... 248/516; 47/40.5; 248/519; 248/525

[58] Field of Search ..... 248/515, 516, 248/519, 523, 511, 371, 398, 288.31, 525; 47/40.5

[56] References Cited

U.S. PATENT DOCUMENTS

| | | | |
|---|---|---|---|
| D. 258,780 | 4/1981 | Wasserman . | |
| D. 329,622 | 9/1992 | Smith . | |
| D. 332,582 | 1/1993 | Quinn . | |
| D. 339,549 | 9/1993 | Hermanson . | |
| D. 342,694 | 12/1993 | Frost . | |
| D. 344,250 | 2/1994 | Johnson et al. . | |
| D. 344,911 | 3/1994 | Stork . | |
| D. 345,943 | 4/1994 | Lujan, Jr. . | |
| D. 347,599 | 6/1994 | Johnson et al. . | |
| D. 349,259 | 8/1994 | Adam . | |
| D. 350,915 | 9/1994 | Stork . | |
| D. 351,570 | 10/1994 | Fillipp . | |
| D. 353,788 | 12/1994 | Frost et al. . | |
| D. 354,021 | 1/1995 | Kielbasa . | |
| 1,253,572 | 1/1918 | Buchanan . | |
| 1,551,093 | 8/1925 | Fletcher . | |
| 1,615,621 | 1/1927 | Goodnow | 248/288.51 X |
| 1,855,762 | 4/1932 | Kaminski . | |
| 1,997,870 | 4/1935 | Merrill . | |
| 2,044,192 | 8/1936 | Templin, Jr. . | |
| 2,337,914 | 12/1943 | Meldrum . | |
| 2,493,633 | 1/1950 | Mart . | |
| 2,587,788 | 3/1952 | Tacy . | |
| 2,605,067 | 7/1952 | Lindsell . | |
| 2,609,169 | 9/1952 | Kroeger . | |
| 2,733,032 | 1/1956 | Farley et al. . | |
| 2,812,916 | 11/1957 | Jonasson et al. . | |
| 2,905,414 | 9/1959 | Zierden . | |
| 2,915,620 | 12/1959 | Robinson . | |
| 2,933,274 | 4/1960 | Mausolf . | |
| 2,980,377 | 4/1961 | Nielsen et al. . | |
| 2,994,498 | 8/1961 | Sager . | |
| 2,997,264 | 8/1961 | Zelenitz . | |
| 3,204,898 | 9/1965 | Manning . | |
| 3,298,642 | 1/1967 | Taylor . | |
| 3,298,643 | 1/1967 | Taylor . | |
| 3,715,095 | 2/1973 | Drablowski . | |
| 3,779,493 | 12/1973 | Gidlof . | |
| 3,783,547 | 1/1974 | Bystrom et al. . | |
| 3,901,469 | 8/1975 | Davis et al. . | |
| 4,126,963 | 11/1978 | Dunbar . | |
| 4,130,965 | 12/1978 | Patton et al. . | |
| 4,156,323 | 5/1979 | Scheffler . | |
| 4,159,096 | 6/1979 | Chase . | |
| 4,231,539 | 11/1980 | Sandham . | |
| 4,254,578 | 3/1981 | Hanfeld . | |
| 4,260,365 | 4/1981 | Kayne . | |
| 4,261,138 | 4/1981 | St. George Syms . | |
| 4,261,402 | 4/1981 | Stanaitis . | |
| 4,286,409 | 9/1981 | Taylor et al. . | |
| 4,354,654 | 10/1982 | Werner et al. | 248/371 |
| 4,381,621 | 5/1983 | Eby . | |
| 4,393,621 | 7/1983 | Rodell . | |

(List continued on next page.)

FOREIGN PATENT DOCUMENTS

| | | |
|---|---|---|
| 0711521A1 | 5/1996 | European Pat. Off. . |
| 153889 | 8/1988 | Japan . |
| 2 115 479 A | 2/1983 | United Kingdom . |

*Primary Examiner*—Ramon O. Ramirez
*Assistant Examiner*—Derek J. Berger
*Attorney, Agent, or Firm*—Calfee, Halter & Griswold LLP

[57] ABSTRACT

An improved Christmas tree stand comprises a receptacle for receiving the trunk of a tree and a base for receiving the receptacle and tree. The base includes an upper shell which can be easily swiveled to any position with respect to a lower shell so as to position a tree vertically in any desired portion without shimming.

35 Claims, 16 Drawing Sheets

Fig. 4

U.S. PATENT DOCUMENTS 4,397,895 8/1983 Poe .
4,408,415 10/1983 Davis et al. .
4,429,846 2/1984 Halvorson .
4,436,272 3/1984 Lile et al. .
4,541,601 9/1985 Corbisello .
4,562,988 1/1986 Bumgardner ..... 248/349.1
4,565,028 1/1986 Stephan .
4,571,882 2/1986 Capen .
4,596,262 6/1986 Tegze .
4,611,781 9/1986 Wiegand .
4,699,347 10/1987 Kuhnley .
4,726,553 2/1988 Wischusen, III .
4,884,363 12/1989 Sofy .
4,901,971 2/1990 Connelly .
4,936,538 6/1990 Royce .
4,967,508 11/1990 Reynolds .
4,976,411 12/1990 Gordon et al. .
5,000,414 3/1991 Rosato .
5,014,461 5/1991 vom Braucke et al. .
5,048,230 9/1991 Bernardy .
5,074,514 12/1991 Smith .
5,086,583 2/1992 Breen .
5,114,113 5/1992 Krinner .
5,121,897 6/1992 Sofy .
5,137,246 8/1992 Idso .
5,201,140 4/1993 Voorhis .
5,209,450 5/1993 Grapes .
5,236,167 8/1993 Tai et al. .
5,243,782 9/1993 Jones .
5,249,772 10/1993 Montie, Jr. et al. .
5,279,071 1/1994 McDougall .
5,290,004 3/1994 Frost et al. .
5,299,381 4/1994 Oldenburg, Jr. .
5,301,462 4/1994 Hronyetz .
5,318,267 6/1994 Rast .
5,320,323 6/1994 Clark, Jr. .
5,323,558 6/1994 Baumler .
5,327,677 7/1994 Rivera .
5,330,368 7/1994 Tsuruzono .
5,333,828 8/1994 Severeid .
5,337,990 8/1994 Brown .
5,338,585 8/1994 Fraus et al. .
5,342,661 8/1994 Wilcox, II .
5,349,997 9/1994 Rial .
5,350,149 9/1994 Evans, Jr. et al. .
5,359,502 10/1994 Cantin .
5,362,024 11/1994 Grinnen .
5,363,591 11/1994 Jones .
5,369,910 12/1994 Copenhaver .
5,375,807 12/1994 Claas .
5,375,808 12/1994 Roy .
5,388,799 2/1995 Keefe .
5,393,031 2/1995 Leve .
5,398,444 3/1995 Murray .
5,407,168 4/1995 Shultz .
5,410,838 5/1995 O'Leary et al. .
5,454,188 10/1995 Sofy .
5,467,959 11/1995 Behringer .
5,507,117 4/1996 Kalman et al. ..... 248/516 X

TREE STAND

AND SUMMARY OF THE INVENTION

The present invention relates to an improvement over the invention shown in U.S. Pat. No. 5,507,117, the disclosure of which is incorporated herein by reference.

In accordance with the present invention, a tree stand for receiving and supporting a tree, such as a Christmas tree, comprises a receptacle for receiving the trunk of the tree and a base for supporting the receptacle when the tree is received therein. The receptacle includes a clamping assembly for securing the trunk of the tree in the receptacle, while the base includes a top portion for releasably receiving the receptacle and a bottom portion for supporting the top portion. The top portion is capable of swiveling about the bottom portion in any desired direction for vertically positioning the tree, while a locking assembly locks the top portion in place with respect to the bottom portion when the tree is placed in the desired vertical position.

With this structure, the tree, once mounted in the inventive tree stand, can be easily moved to a fully upright position with its center of gravity centered over the base, even if the tree trunk is crooked or not centered in the receptacle. Therefore, shimming the tree stand or otherwise securing the tree in place as typically done with conventional Christmas tree stands is avoided.

BRIEF DESCRIPTION OF THE DRAWINGS

The present invention may be more readily understood by reference to the following drawings wherein.

DETAILED DESCRIPTION

Figure 1:
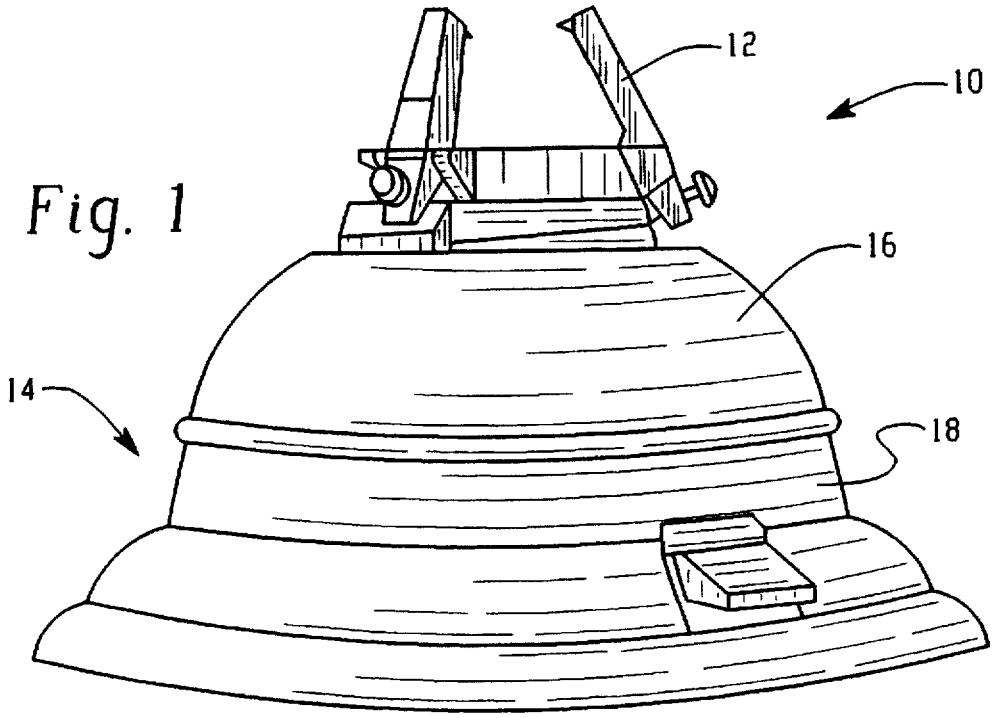
FIG. 1 is a schematic plan view of the inventive Christmas tree stand.
Figure 2:
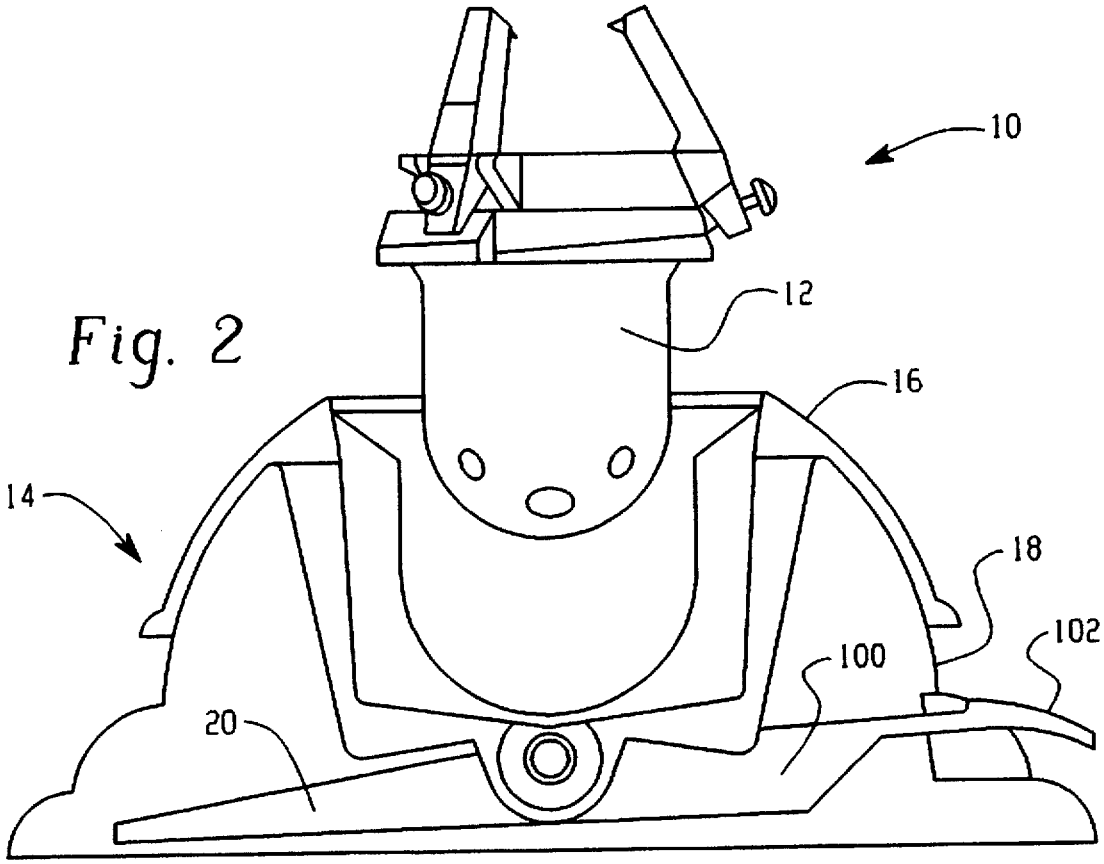
FIG. 2 is an exploded schematic view of the tree stand of FIG. 1.

Referring to FIGS. 1, 2, 3 and 4, the inventive tree stand, generally indicated at 10, comprises a receptacle 12 for receiving the trunk of a tree and a base 14 composed of a top portion or upper shell 16, a bottom portion or lower shell 18 and a locking assembly 20.

Figure 3A:
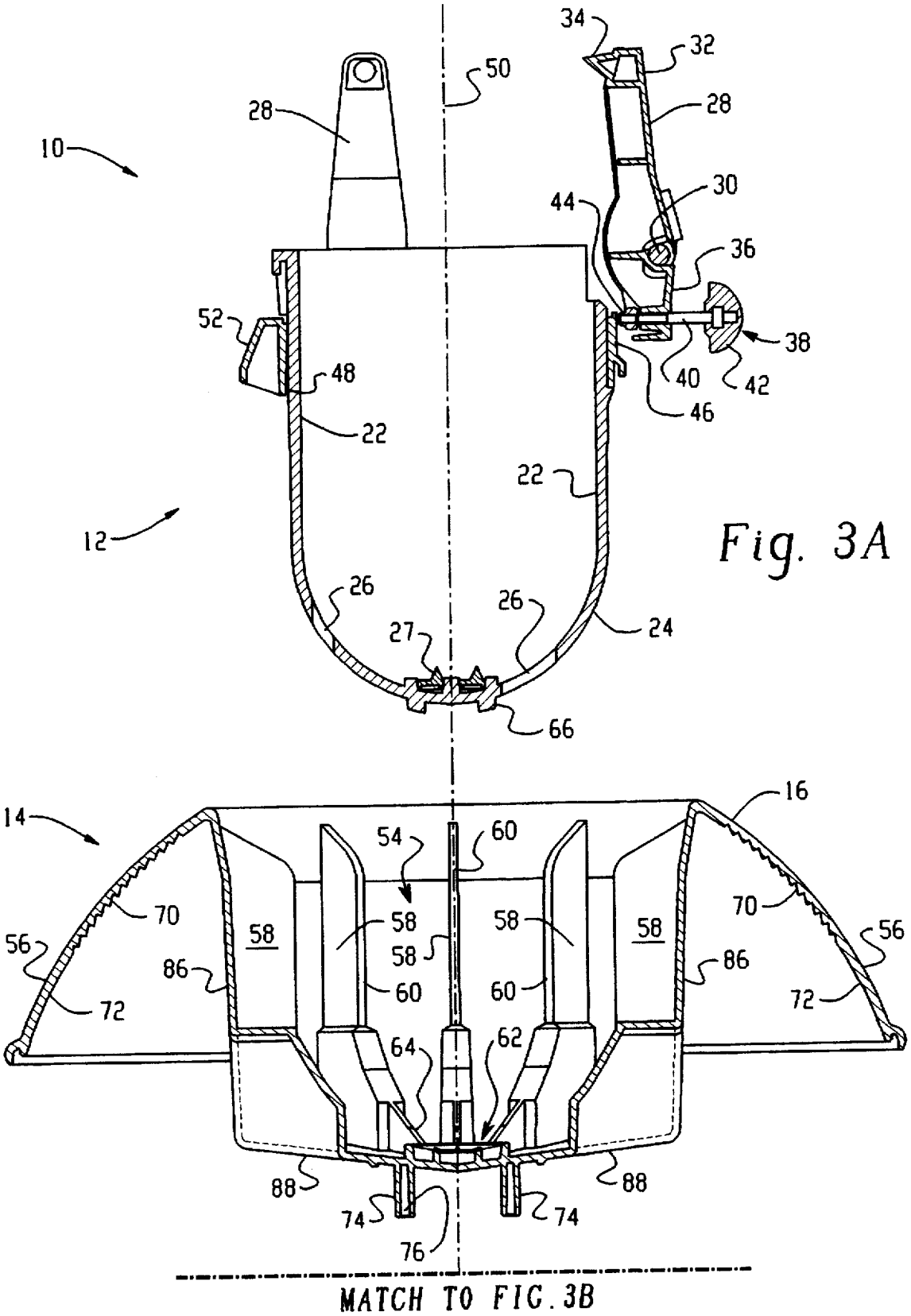
FIG. 3 is an exploded view, partially in cross section, of the tree stand of FIG. 1.
Figure 3B:
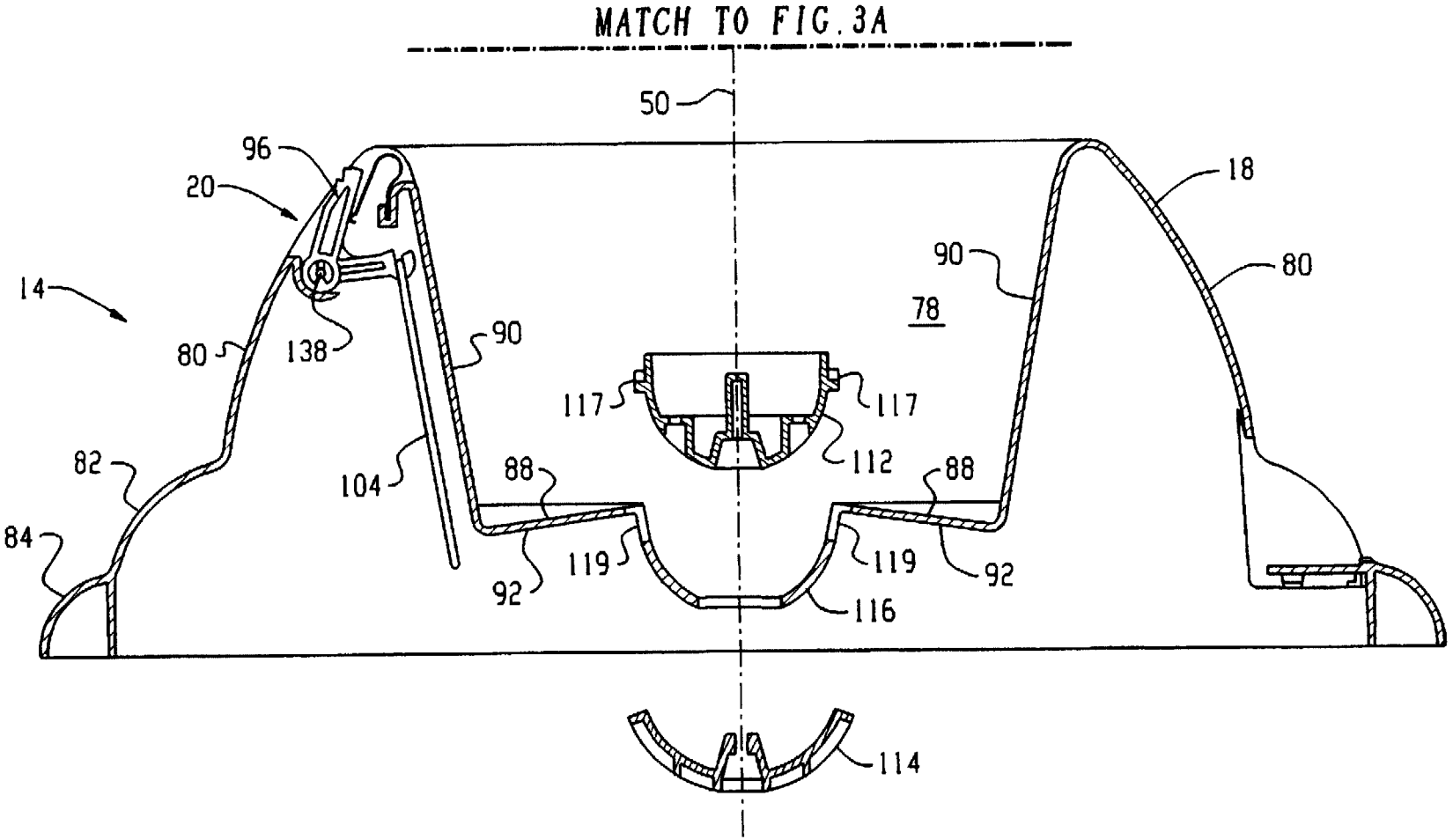
Figure 4:
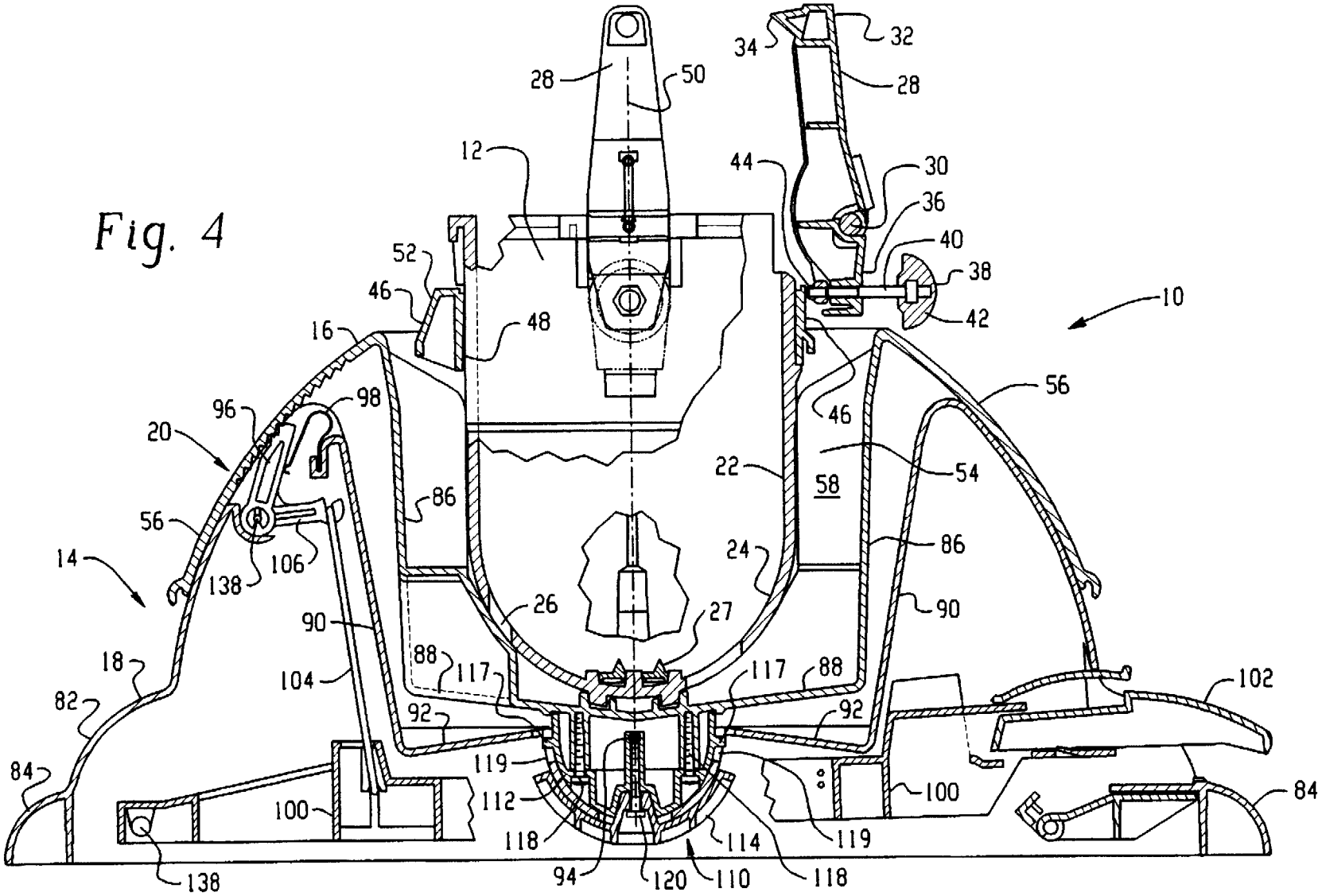
FIG. 4 is another plan view of the tree stand of FIG. 1 in partial cross section showing the tree stand in an assembled condition.

As shown in FIGS. 3 and 4, receptacle 12 includes an annular sleeve 22 for substantially surrounding the trunk of a tree when the tree is received in the receptacle. In addition, receptacle 12 also includes bottom section 24 integral with annular sleeve 22 in the shape of an elongated cup-shaped member defining openings 26 therein for receiving water or other liquid in the base. Bottom section 24 is shaped to matingly engage with upper shell 16 of base 14 so that receptacle 12 can be releasably secured in base 14 without fasteners, if desired. In addition, bottom section 24 defines projections 27 thereon for engagement with the bottom of a tree trunk placed therein.

Receptacle 12 includes a plurality of arms 28, each of which is hingedly mounted at hinge 30 to an upper portion of receptacle 12 integral with annular sleeve 22. A first end 32 of each arm 28 extends above the receptacle and includes a spike 34 for engaging the trunk of the tree when received therein. Each of arms 28 also includes a second end 36 which is adapted to be manually biased away from annular sleeve 22 of receptacle 10 by means of a movable fastener 38, which in the embodiment shown is a hand actuated screw 40 having a knob 42 on one end thereof and a distal end 44 on the other end thereof for pushing the lower or second end 36 of arm 28 away from annular sleeve 22 of the receptacle when screw 40 is turned by hand.

In the particular embodiment shown, receptacle 12 is provided with an accelerator member for rapidly moving spikes 34 into approximate engagement with the tree trunk placed in the receptacle. This accelerator member comprises an accelerator ring 46 which is rotably movable about annular sleeve 22 between an open position and an engaging position. Accelerator ring 46 includes an inside cylindrical surface 48 concentric with the outside cylindrical surface of annular sleeve 22 for enabling annular ring 46 to rotate about the common central axis 50 of receptacle 12. Accelerator ring 46 also includes an outer biasing surface 52 for engagement with the distal ends 44 of hand actuated screws 40. In the particular embodiment illustrated in FIGS. 3 and 4, accelerator ring 46 is in its open position. In this configuration, the thickness of accelerator ring 46, i.e. the distance between inside cylindrical surface 48 and biasing surface 52, in the places where it engages the distal ends 44 of the hand actuated screws, is minimized. This allows second or lower end 36 of arms 28 to be as close as possible to annular sleeve 22, which in turn keeps spikes 34 on first end 32 of arms 28 as far away from common central axis 50 as possible, thereby keeping the opening between respective spikes 34 as big as possible.

When the trunk of a tree is placed inside receptacle 10, arms 28 can be moved from a fully open position as illustrated in FIGS. 3 and 4 to a position in which at least one spike 34 just engages the trunk of the tree simply by rotating accelerator ring 46 from its open position towards its engaging position. As a result of this rotation, the thickness of the accelerator ring at each place where it engages a respective distal end 44 of a screw 40 increases. This acts on each hand actuated screw 40 to bias second or lower end 36 of arm 28 away from annular ring 22 and hence to force spike 34 towards the trunk of the tree. Once at least one spike 34 engages the trunk of the tree, further rotation of accelerator ring 46 is essentially prevented. At that time, arms 28 can be moved into secure engagement with the tree trunk by tightening hand actuated screws 40 by hand.

As shown in FIGS. 3 and 4, base 14 comprises top portion or upper shell 16 and bottom portion or lower shell 18. Upper shell 16 includes a central section 54 and a peripheral section 56. Central section 54 is in the form of a liquid tight container so that upper shell 16 can hold water for feeding a tree received therein. Central section 54 includes a plurality of flanges 58 whose outside surfaces 60 are configured to matingly engage with the outside surfaces of cup-shaped bottom section 24 of receptacle 12. The bottom 62 of central section 54 defines a plurality of wedge-shaped indentations 64 (FIG. 3) which are adapted to matingly engage a plurality of wedge shaped protrusion 66 carried on the bottom of receptacle 12.

These wedge-shaped protrusions and indentations, acting through the force created by the weight of the tree and receptacle, prevent receptacle 12 from rotating with respect to upper shell 16 about their common central axis 50. In the same way, gravity keeps receptacle 12 and upper shell 16 of the base aligned with one another, also along their common central axis 50, primarily because of the elongated shape of bottom section 24 of receptacle 12. Accordingly, even though the receptacle and upper shell are not secured together by any fasteners, they are nonetheless integrally joined when the stand is in an "in-use" condition. At the same time, entry of the receptacle into the base and release of the receptacle from the base are very easy, since no separately-actuated fasteners are required.

Peripheral section 56 of upper shell 16 of the base takes the form of a spherical surface which defines at least one set of grooves 70 on an internal surface 72 thereof. Grooves 70 are adapted to engage locking elements of a locking assembly contained in lower shell 18 of base 14, as more fully discussed below.

A plurality of projections 74 depend downwardly from the lower surface of central section 54 of upper shell 16. Projections 74 are provided with screw holes 76 therein for receiving attachment screws, as further discussed below.

Lower shell 18 of base 12 includes a central receiving section 78 for receiving central section 54 of upper shell 16. Lower shell 18 also includes an outer spherical wall 80, a shoulder 82 and a rim 84. Outer spherical wall 80 is configured to slidingly engage inside surface 72 of peripheral section 56 of upper shell 16. Also, as shown in FIG. 4, sidewalls 86 and bottom 88 of the upper shell are spaced away from the sidewalls 90 and bottom 92 of lower shell 18 so that upper shell 16 can pivotally move (i.e. swivel) with respect to bottom portion 18 about a common pivot point 94.

In order to facilitate pivotal movement of upper shell 16 with respect to lower shell 18, base 12 is provided with a universal joint generally indicated at 110 in FIG. 4. As shown in FIGS. 3 and 4, universal joint 110 takes the form of a socket ball 112 and a socket cap 114. Socket ball 112 is rigidly secured to upper shell 16 of the base by screws 118 engaging projections 74 thereon, while socket cap 114 is rigidly secured to socket ball 112 by screw 120. Socket ball 112 and socket cap 114 engage the inside and outside surfaces, respectively, of spherical section 116 defined in lower shell 18 of base 14. In addition, socket ball 112 is provided with pins 117 which are received in windows 119 in spherical section 116 of the lower shell. Spherical section 116, socket cap 114, socket ball 112, outer spherical wall 80 of lower shell 18 and peripheral section 56 of upper shell 16 all lie on concentric spheres centered about common pivot point 94. This allows upper shell 16 of base 14 to swivel freely with respect to lower shell 16 in any direction. However, pins 117 on the socket ball 112, which are received in windows 119 of the lower shell, prevent rotation of the upper shell with respect to its own central axis shown at 50 in FIGS. 3 and 4. Accordingly, although upper shell 16 can swivel freely with respect to lower shell 18 in any direction when locking assembly 20 is in its open or disengaged position, it cannot rotate about common vertical axis 50. This enables the upper shell, including receptacle 12 and a tree received therein, to be pivoted to any desired direction while at the same time ensuring that the locking assembly in the lower shell always registers with a groove 70 in upper shell 16 of base 14 when the locking assembly is in an engaged position.

A locking assembly generally indicated at 20 is provided in lower shell 18 of the base for locking upper shell 16 with respect to lower shell 18. Locking assembly 20 includes at least one locking element 96, an associated biasing member or spring 98 biasing locking element 96 into an engaged or locking position as illustrated in FIG. 4, a locking arm 100 provided with a pedal 102 (FIG. 2) and a connecting rod 104 connecting locking arm 100 to locking element 96.

In the particular embodiment shown, the inventive tree stand includes four separate locking elements 96 equally spaced around outer spherical wall 80 of lower shell 18. Since locking arm 100 pivotally moves with respect to lower shell 18, and since connecting rods 106 are attached to different places along the length of locking arm 100, some connecting rods 104 and connecting arms 106 will be longer than others to accommodate different degrees of movement of locking arm 100 along its length when pedal 102 is depressed.

Figure 5:
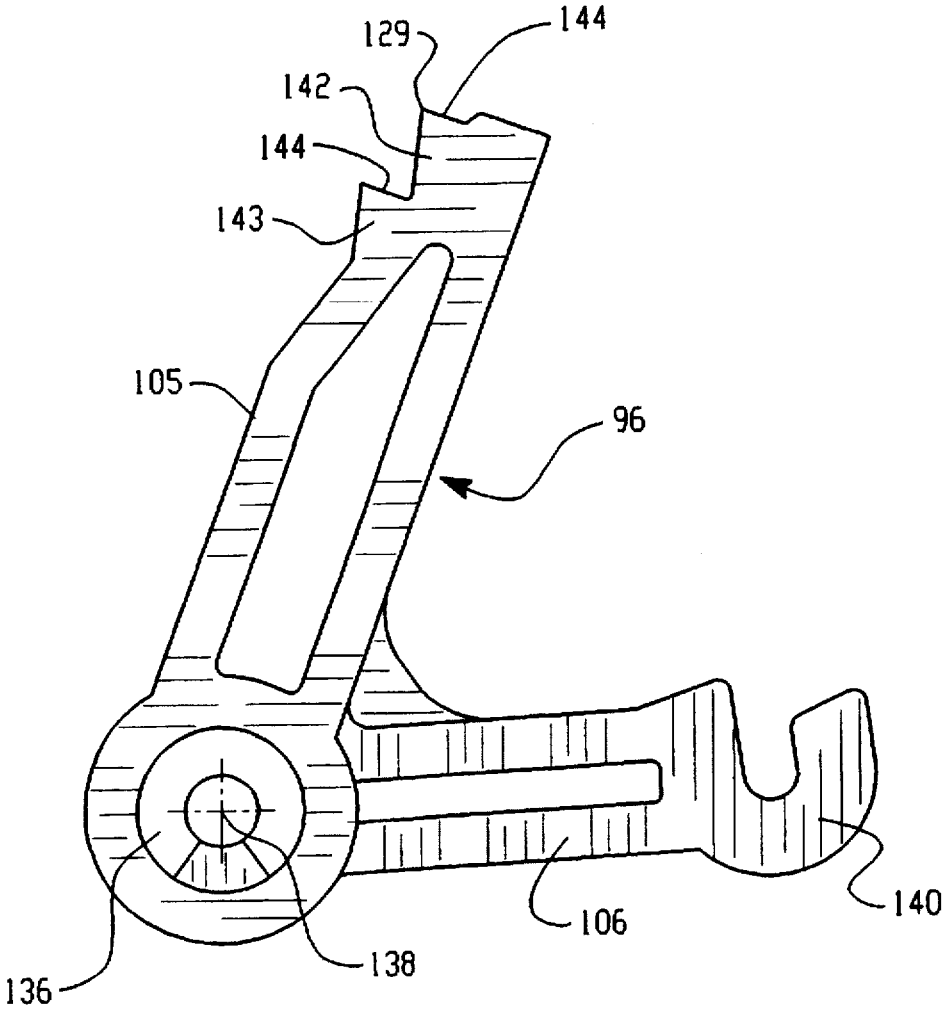
FIG. 5 is a plan view of a locking element used for locking the top portion with respect to the bottom portion of the base of the tree stand of FIG. 1.

As shown in FIG. 5, each locking element 96 is composed of an actuating arm 105 and a connecting arm 106 integral therewith. Both the actuating arm and the connecting arm are mounted on bushing 136 which is provided to enable locking element 96 to pivot about pivot axis 138 integral with lower shell 18. The distal end of connecting arm 106 defines a hook 140 for attachment to connecting rod 104 of the locking assembly. See FIG. 4. The distal end of actuating arm 105 carries an upper tooth 142 and a lower tooth 143 for engagement with respective grooves 70 in peripheral section 56 of upper shell 12. As shown in FIG. 5, each of teeth 142 and 143 defines a lock bearing surface 144 for engagement with a groove bearing surfaces of a respective groove 70, as described below. If desired, lock-bearing surface 144 of each tooth may be made slightly curved in configuration to conform exactly with the shape of these groove-bearing surfaces as more fully discussed below.

In the configuration illustrated in FIG. 4, locking assembly 20 is in its locking or engaged position with locking element 96 engaging at least one groove 70 in upper shell 16 of the base. When pedal 102 is depressed, locking arm 100 pivots downwardly, which in turn causes connecting rod 104 to pull connecting arm 106 downwardly. As a result, locking element 96 pivots about axis 138 out of engagement with grooves 70 in upper shell 16 of the base. This allows upper shell 16 to move freely with respect to lower shell 18 for vertically positioning a tree, as desired. Once upper shell 16 is moved into a desired position, pedal 102 is released. This causes spring member 98 to push locking element 96 back into engagement with grooves 70 in upper shell 16 of the base, thereby locking the upper shell and lower shell of the base with respect to one another.

Figure 6:
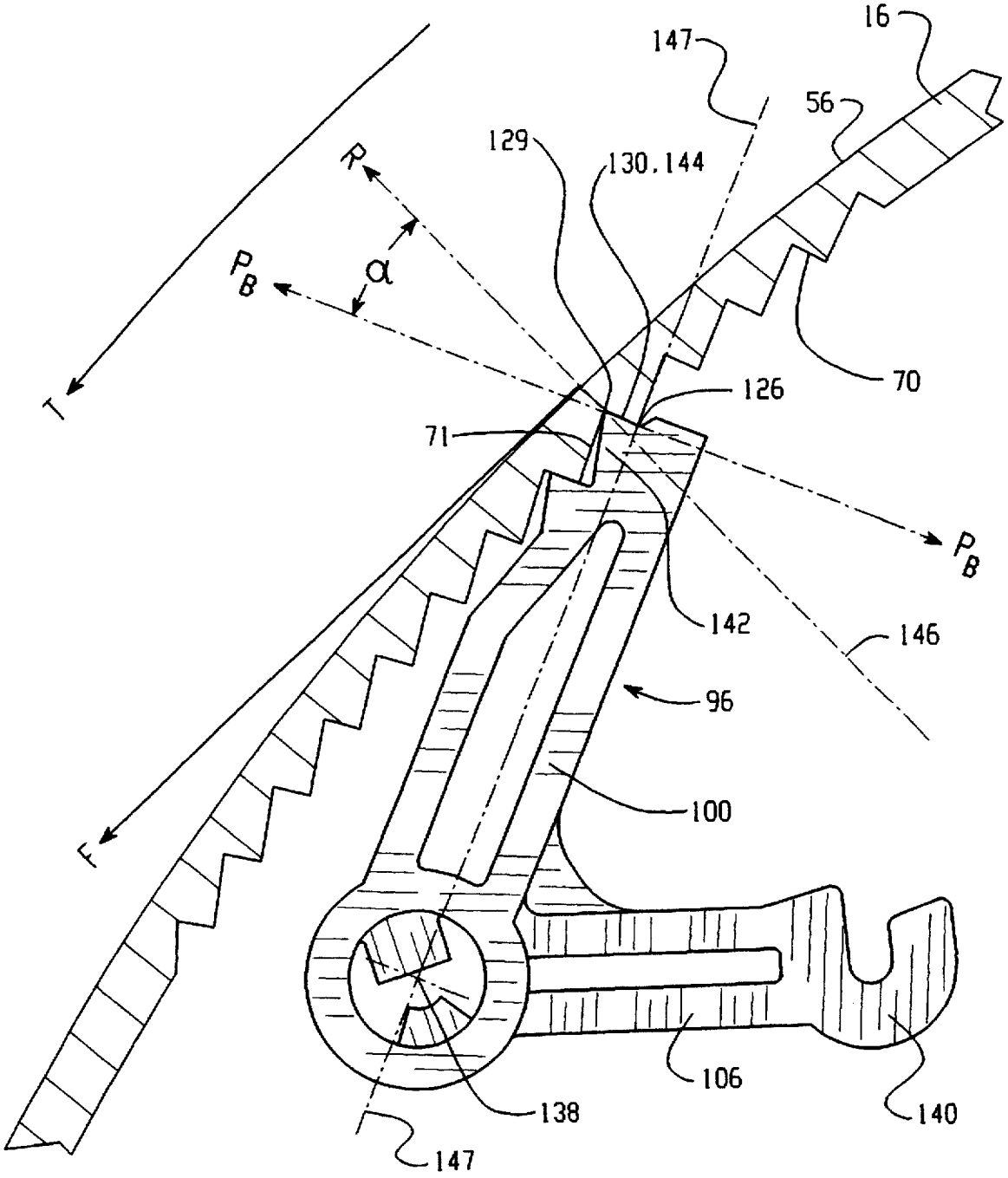
FIG. 6 is a partial cross sectional view illustrating the engagement of the locking element of FIG. 5 with the grooves in the top portion of the base of the tree stand of FIG. 1.
Figure 7:
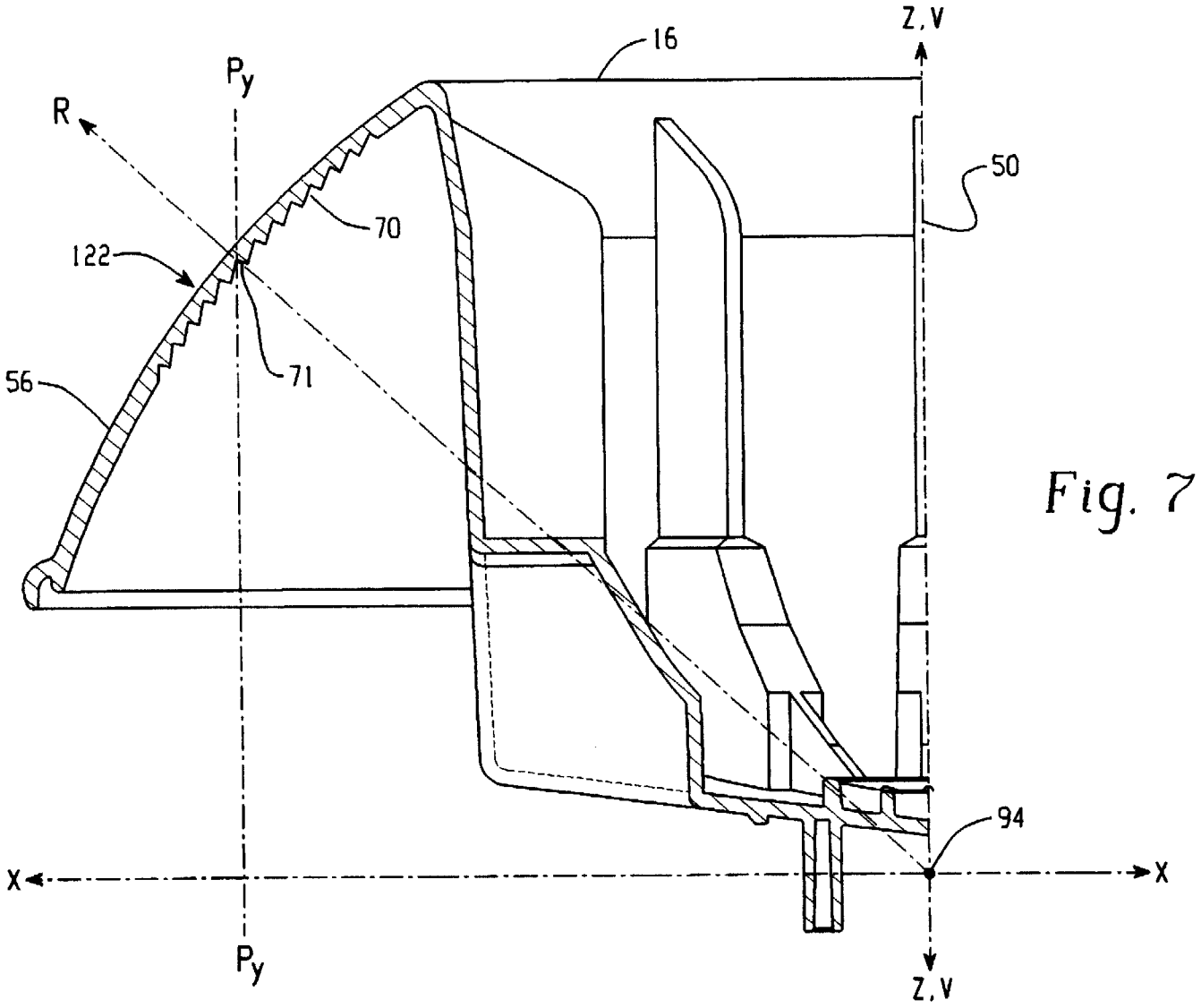
FIG. 7 is a partial cross sectional view of part of the top portion the base of the tree stand of FIG. 1.

FIGS. 6 and 7 illustrate the cooperation between locking element 96 and upper shell 16 of base 12 of the inventive tree stand. When locking element 96 is in a locking or engaged position, as illustrated in FIG. 6, teeth 142 and 143 thereof engage grooves 70 in peripheral section 56 of base upper shell 16. For convenience, the groove which engages upper tooth 142 of locking element 96 will be referred to hereinafter as "locking groove 71". If a tree were mounted in the inventive Christmas tree stand with its center of gravity to the left of center as illustrated in FIG. 6, a torque would be created in the direction of arrow T which would tend to cause base upper shell 16 to rotate counterclockwise in the plane of FIG. 6. This torque, in turn, creates a force acting in the direction of arrow F which is on a tangent to the sphere defined by peripheral section 56 of upper shell 16.

As shown in FIG. 6, lock-bearing surface 144 of locking element 96 (FIG. 5) as well as associated groove bearing surface 130 of locking groove 71 substantially lie on a plane $P_B$ arranged at an angle $\alpha$ with respect to a radius R passing through common pivot point 94 as well as through the peak or cusp 129 of upper tooth 142 on locking element 96 when in its locking or engaged position. Plane $P_B$ is also arranged such that a centerline 147 passing through pivot axis 138 and peak 126 of groove 71 is perpendicular to plane $P_B$. Angle $\alpha$ is kept as small as possible, and in the particular embodiment shown is 23°. With this structure, substantially all of the force F acts through actuating arm 105 onto pivot axis 138 of base lower shell 18. Little if any of force F is thereby transmitted through connecting arm 106 of locking element 96 through the other elements of the locking assembly including connecting rod 104, hinge 108, locking arm 100 and pedal 102. It will thus be appreciated that locking element 96 can be easily pivoted about pivot axis 138 from its locking position as illustrated in FIG. 6 to an open position, even if force F is quite substantial. This is because lock-bearing surface 144 of locking element 96 moves in a direction which is aligned with plane $P_B$ and substantially perpendicular to force F. Therefore, even if torque T is considerable, locking element 96 can be easily moved into its disengaged position because little, if any, of force F opposes movement of tooth 142 out of engagement with locking groove 71.

Figure 8:
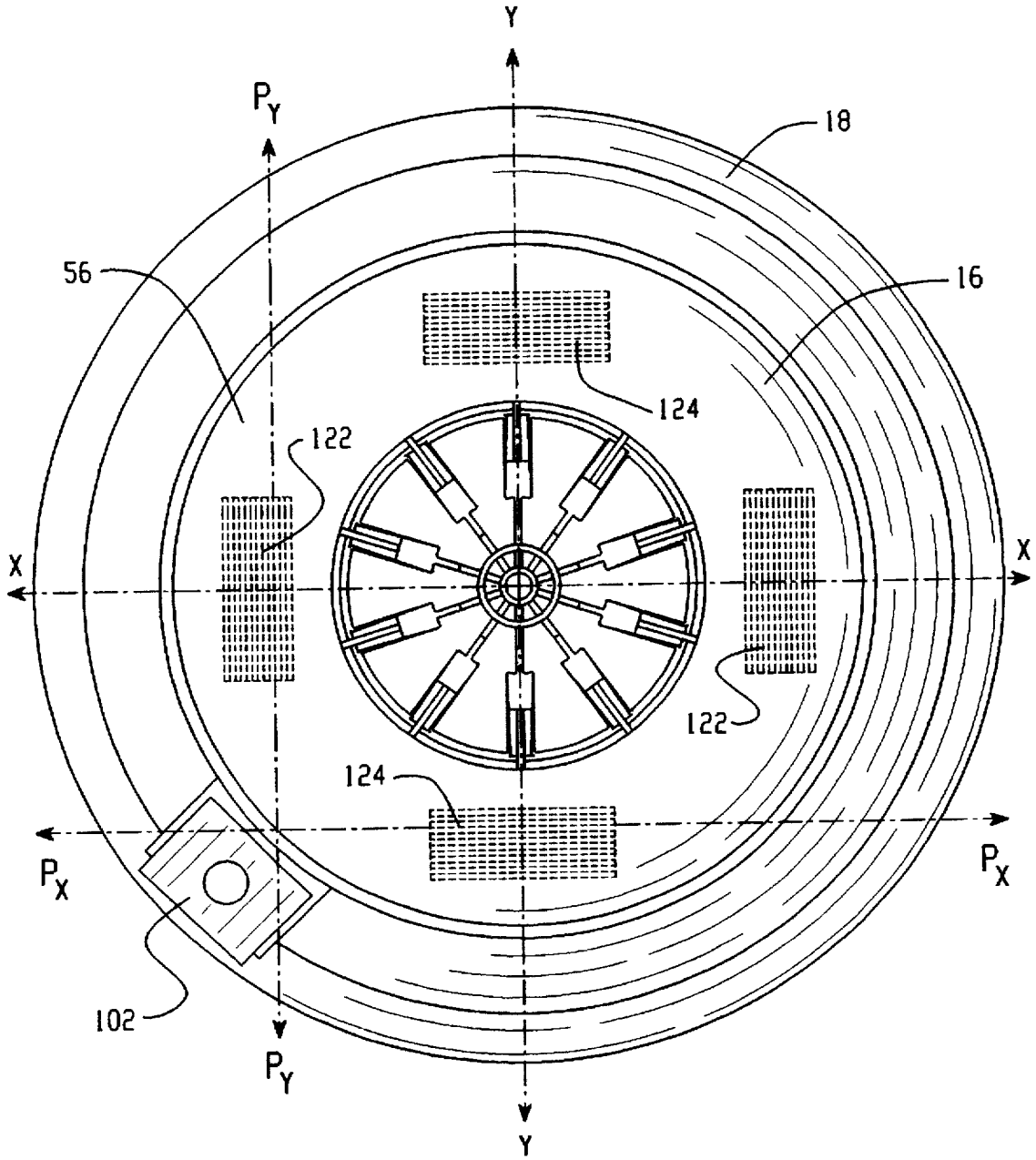
FIG. 8 is a top view of the base of the tree stand of FIG. 1.

FIGS. 6, 7, 8, 9, 10A and 10B illustrate the configuration of grooves 70 in more detail. In the particular embodiment shown, the inventive tree stand is provided with four sets of grooves 70 and associated locking elements 96 arranged at 90 degree intervals around base 14. This is illustrated in FIG. 8, which shows (in dashed line) four different sets of grooves 70, two of these sets indicated at 122 and the other two sets being indicated at 124.

Referring now to FIGS. 7 and 8, lower shell 18 of base 14 defines orthagonally arranged X, Y and Z axes intersecting at common pivot point 94. In the configuration illustrated in FIGS. 6, 7, 8, 9, 10A and 10B, upper shell 16 is arranged in a "centered" position with the central axis of receptacle 12, upper shell 16 and lower shell 18 being aligned on common central axis 50. See FIG. 4. In this configuration, the Z axis of lower shell 18 is aligned with the central axis 55 of the upper shell, as shown in FIG. 7, while the Y axis of the lower shell is perpendicular to the plane of FIG. 7.

Referring now to FIGS. 6 and 7, locking groove 71, i.e. the groove 70 which engages tooth 142 of locking element 96 when in an engaged position, is defined by the intersection of spherical peripheral section 56 of upper shell 16 of the base and a respective plane $P_Y$. As can further be seen in FIG. 7, plane $P_Y$ is arranged parallel to the Z axis of lower shell 18 as well as perpendicular to the X axis and parallel to the Y axis of the lower shell. Because the intersection of a sphere and a plane perpendicular to the diameter of the sphere is a circle, it will be appreciated that locking groove 71 defines a circular arc centered on axis X, the diameter of which equals the distance between axis X and tooth 142 on locking element 96 when in an engaged position. This is more fully illustrated in FIGS. 10A and 10B which show that locking groove 71 in plan view defines a circular arc.

With this structure, it will be appreciated that the portion of locking groove 71 engaging tooth 142 on locking element 96 always remains in the same place with respect to locking element 96 regardless of how upper shell 16 is pivoted about the axis X of lower shell 18. This, in turn, means that upper shell 16 can be freely pivoted about the X axis of lower shell 18 to any desired position without altering the way locking element 96 registers with or engages locking groove 71.

Figure 9:
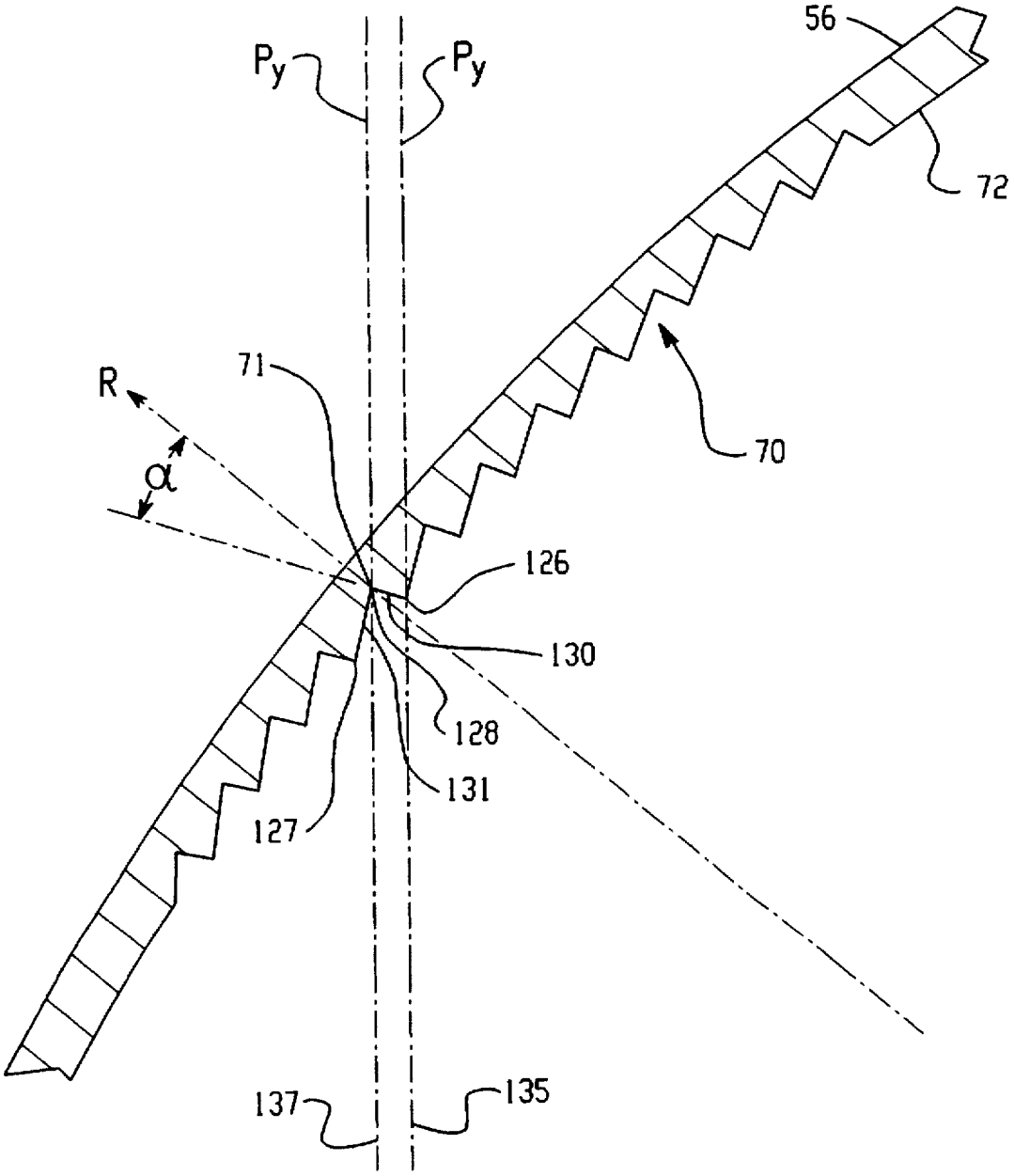
FIG. 9 is a cross sectional view similar to FIG. 6 further illustrating the profile of the grooving system provided in the top portion of the base of the tree stand of FIG. 1.

Referring to FIG. 9, each of grooves 70 is actually defined by an upper peak 126, a lower peak 127 a valley 128, a groove-bearing surface 130 between upper peak 126 and valley 128, and a secondary surface 131 between lower peak 127 and valley 128. In the preferred embodiment of the invention, both the peaks 126 and 127 as well as valley 128 lie on their own respective planes $P_Y$. In addition, peaks 126 and 127 lie on the same sphere, while valley 128 lies on a different, slightly larger sphere.

This is illustrated in FIG. 9, which shows that upper peak 126 of locking groove 71 lies on the intersection of plane $P_Y$ designated at 135 and the spherical interior surface 72 of upper shell 16. Similarly, valley 128 lies on the intersection of a plane $P_Y$ designated at 137 and a sphere slightly large in diameter than, but concentric with, spherical interior surface 72. In the same way, lower peak 127 lies on the intersection of still another plane $P_Y$ (not shown) parallel to and slightly to left of plane 137. Since the peaks and valley of locking groove 71 lie on respective planes perpendicular to the X axis of the lower shell, both peaks as well as the valley will remain in the same place with respect to tooth 142 on locking element 96 regardless of how upper shell 16 is pivoted about the X axis of the lower shell. As a result, groove-bearing surface 130 extending between upper peak 126 and valley 128 will also remain in the same configuration with respect to lock-bearing surface 144 of tooth 142 of locking element 96 regardless of the position of upper shell 16. This means that, regardless of how upper shell 16 is pivoted about the X axis of lower shell 18, lock-bearing surface 144 of locking element 96 will always engage groove-bearing surface 130 of locking groove 71 in the same way.

From the above, it can be seen that locking groove 71 will always engage tooth 142 on locking element 96 in the same way regardless of how upper shell 16 pivots about its X axis with respect to lower shell 18. However, in actual practice, rarely will upper shell 16 pivot only about its X axis in order to achieve the desired vertical positioning of a tree. Rather, in the vast majority of cases, upper shell 16 will need to pivot about its Y axis as well as its X axis to achieve the desired vertical positioning. An important feature of the inventive tree stand is that the grooves 70 in upper shell 16 are designed to engage respective locking elements 96 in locking assembly 20 in the same way even when upper shell 16 pivots about the Y axis of lower shell 18 as well as the X axis.

Figure 10A:
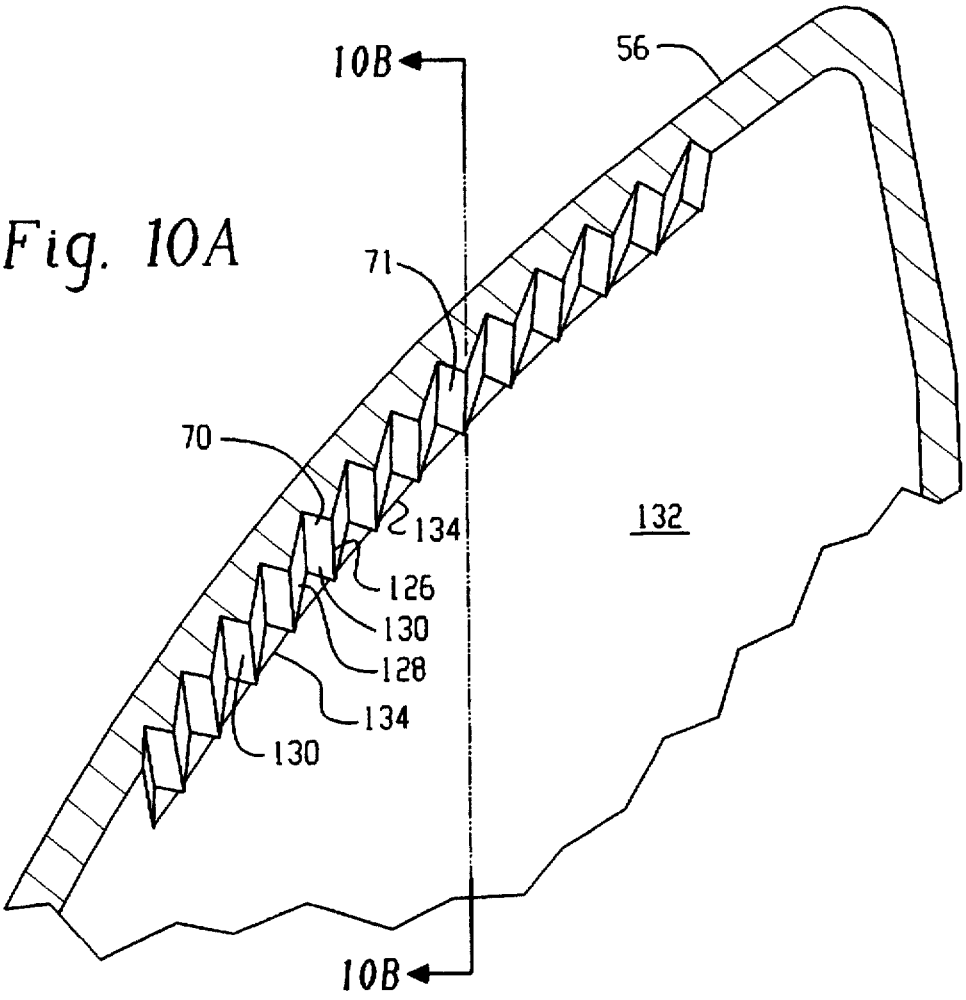
FIG. 10A and 10B are partial plan views, partially in cross-section, further illustrating the grooving system of FIG. 7.
Figure 10B:
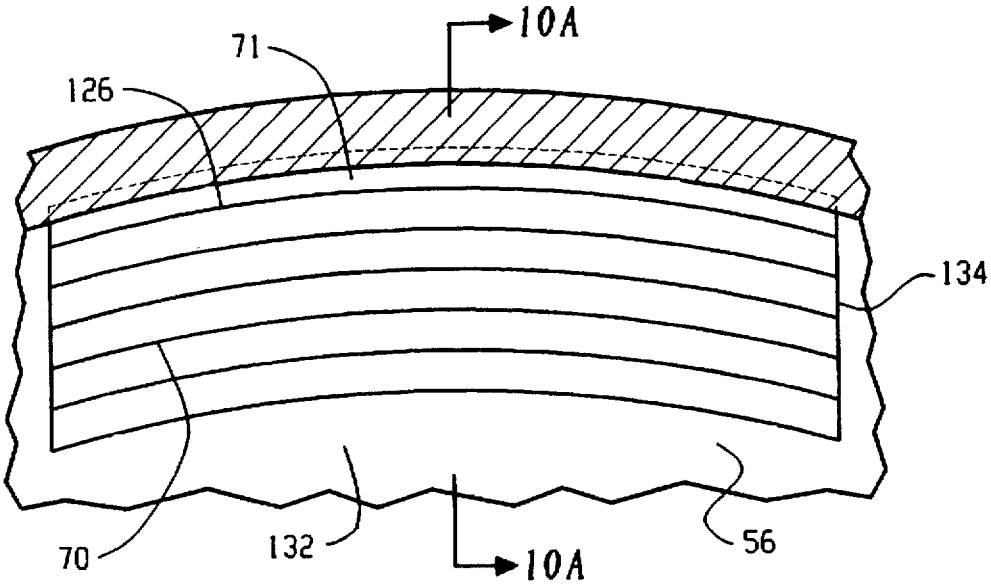
Figure 11A:
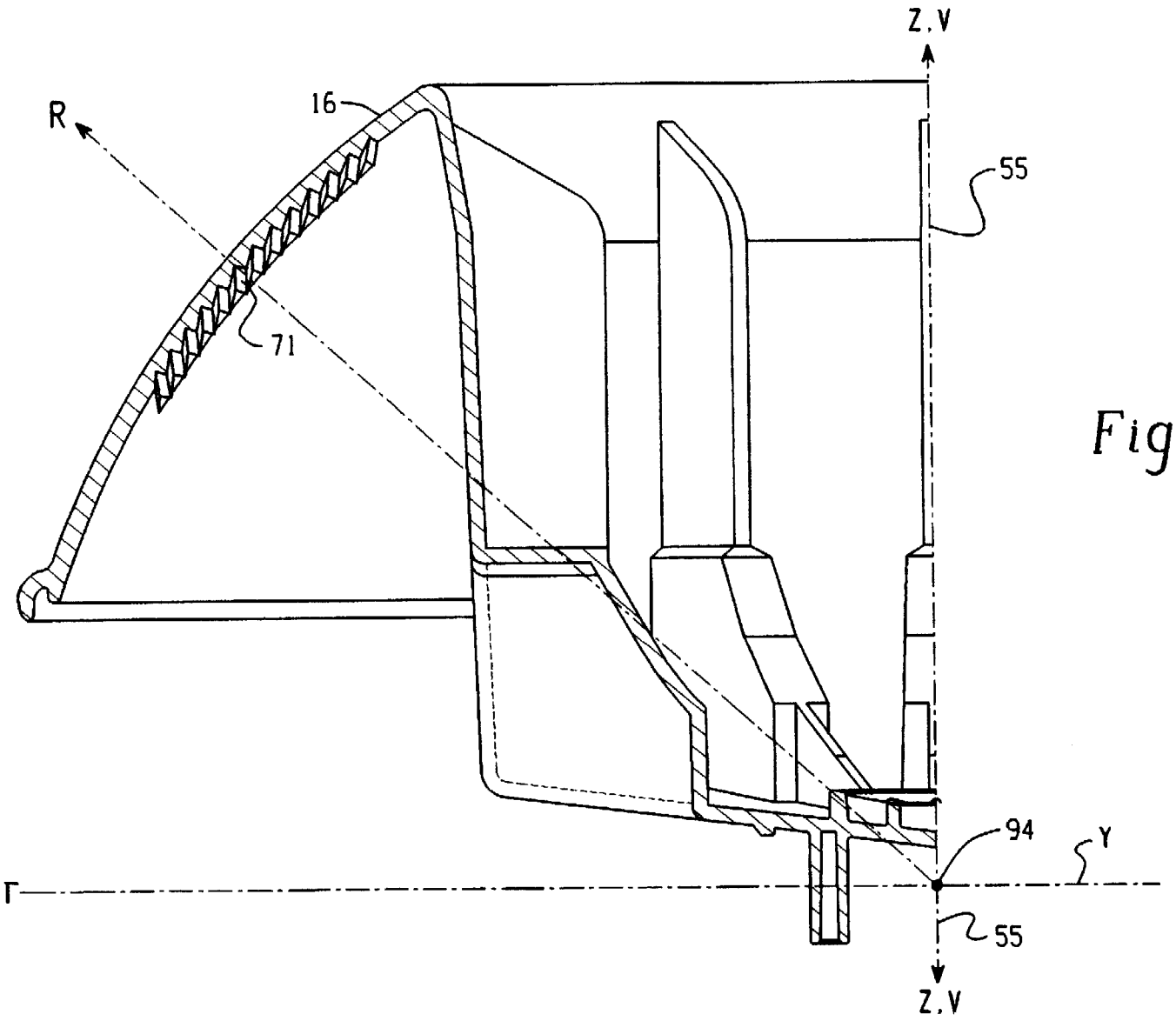
FIGS. 11A, 11B and 11C are plan views similar to FIG. 5 illustrating the top portion of the base of the tree stand of FIG. 1 being moved into three different positions for moving a tree to a desired vertical position.
Figure 11B:
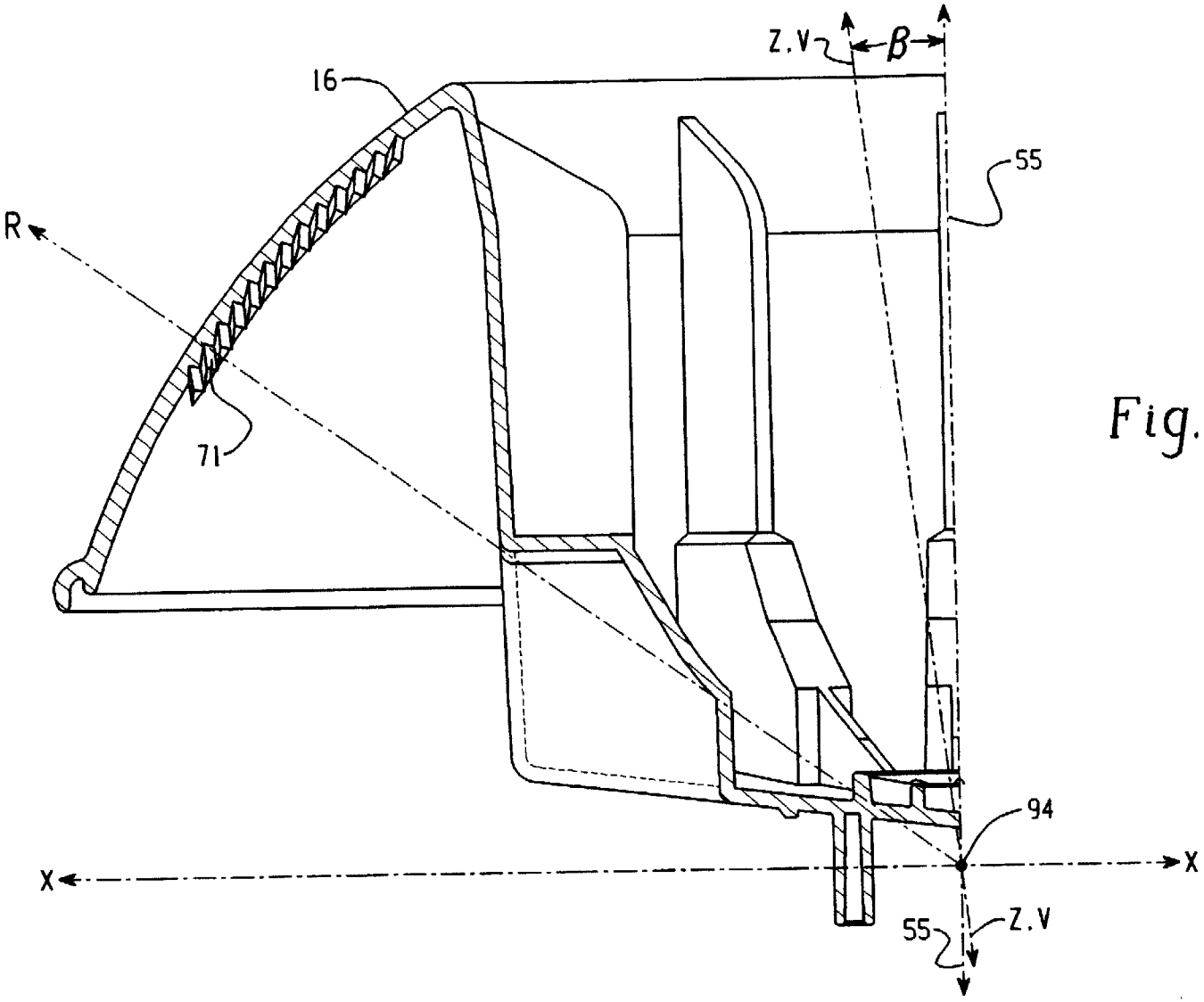
Figure 11C:
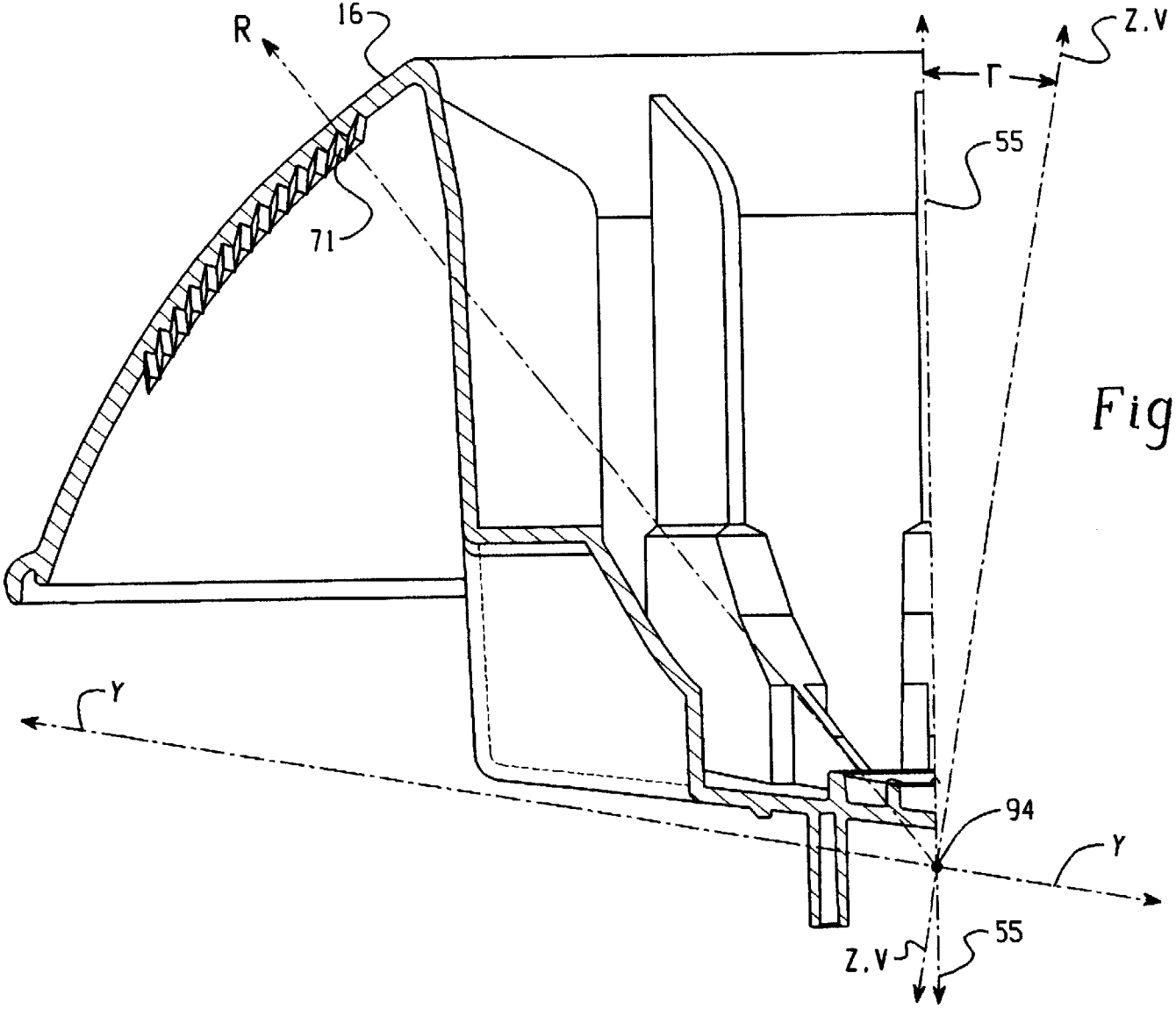

This feature of the present invention is more fully illustrated in FIGS. 11A, 11B and 11C. In each of these figures, line R denotes a radius passing through common pivot point 94 and the tip or cusp of upper tooth 142 on locking element 96 when in an engaged or locking position. FIG. 11A illustrates the position of radius R with respect to upper shell 16 when the central axis 55 of upper shell 16 is aligned with central axis 50 of lower shell 16, which is the vertical, as shown by line V in FIG. 11A. Thus, FIG. 11A shows upper shell 16 as being in the same position with respect to lower shell 18 as shown above in connection with FIGS. 6, 7, 8, 9, 10A and 10B. FIG. 11B, on the other hand, illustrates the position of radius R when upper shell 16 is tilted clockwise by an angle β with respect to the vertical, while FIG. 11C illustrates the position of radius R when upper shell 16 is tilted counterclockwise at an angle Γ with respect to the vertical. In each instance, a different groove 70 is arranged to engage upper tooth 142 of locking element 96 (FIG. 6), thereby becoming the new locking groove 71.

In accordance with the present invention, each of grooves 70, when that groove 70 is arranged to engage tooth 142 of locking element 96 and thereby becomes the new locking groove 71, is defined by the same geometry defining original locking groove 71. In particular, each groove 70 is configured so that when it registers with upper tooth 142 on locking element 96, its peaks and valley are defined by the same intersection of spheres and planes as define the upper peak, lower peak and valley of locking groove 71 in FIG. 9. As a result, the new locking groove 71 will still present the same profile to locking element 96 as original locking groove 71 even if upper shell 16 is tilted about the Y axis of the lower shell as illustrated, for example, in FIG. 11B. Thus, even when upper shell 16 is tilted about this Y axis as illustrated in FIGS. 11B, it can still be further pivoted about the X axis of the lower shell with the new locking groove 71 engaging tooth 142 of locking element 96 in the same way as original locking groove 71.

An important feature of the inventive tree stand is that lock-bearing surfaces 144 on teeth 142 and 143 of locking elements 96 remain in surface-to-surface contact with groove bearing surfaces 130 in upper shell 16 regardless of the position of the upper shell with respect to the lower shell. By surface-to-surface contact is meant that contact between a locking element and an associated groove is not restricted to a point (such as the point of a pencil) or a line (such as the ridge or peak on a tooth) but rather extends over a surface area of at least some reasonable amount, preferably at least about a few square millimeters. This is because surface-to-surface contact substantially reduces stress on lock-bearing surface 144 of locking elements 96 and groove-bearing surface 130 of grooves 70. This, in turn, enables these components to be made from plastics and other less expensive materials rather than stronger, more expensive materials such as metals and the like.

As explained above in connection with FIG. 6, the lock-bearing surfaces 144 of locking elements 96 are arranged to mate with the groove bearing surfaces 130 of respective grooves 70 when upper shell 16 is in a "centered" or aligned position as illustrated in FIG. 4. Thus, when upper shell 16 is in this position, contact between the associated lock-bearing surfaces of the locking elements and the groove-bearing surfaces of the grooves will be on a surface-to-surface basis. Now, as described earlier, each of grooves 70 is configured to register with and engage teeth 142 and 143 on locking element 96 in the same way regardless of how upper shell 16 is tilted about the X and Y axes of lower shell 18. This means that regardless of how upper shell 16 is positioned with respect to lower shell 18, the lock-bearing surfaces 144 of the teeth of locking element 96 will always be in surface-to-surface contact with groove-bearing surfaces of the grooves 70 they engage.

Figure 12:
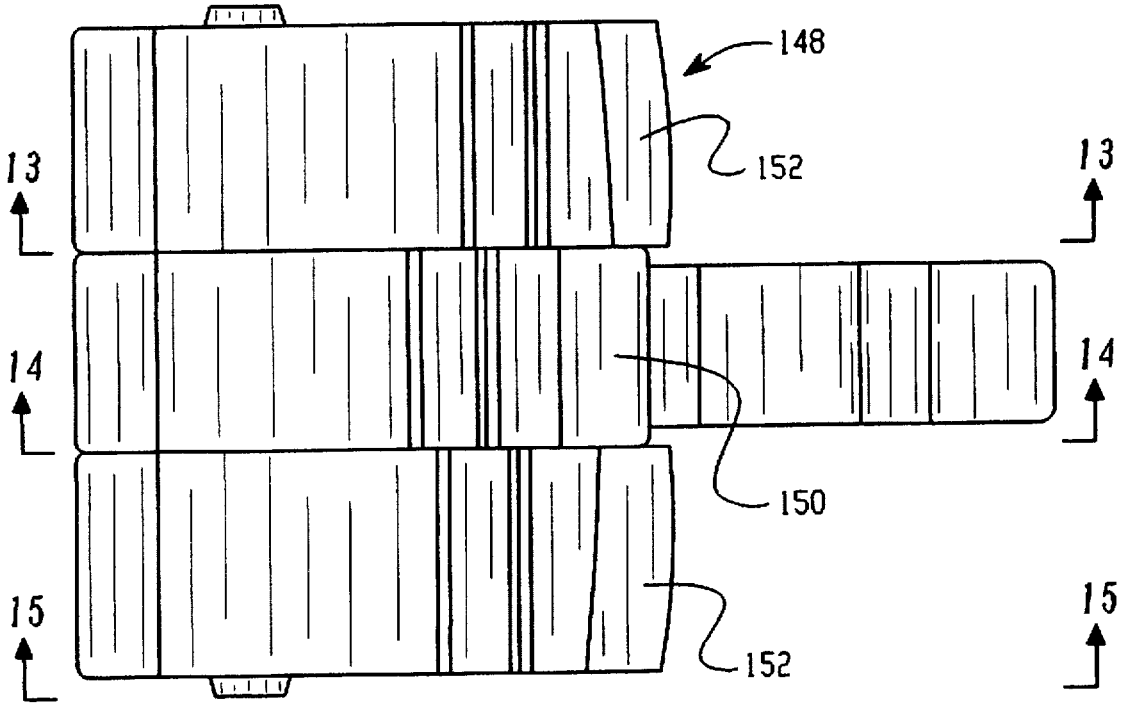
FIG. 12 is a top view of a preferred locking element for use in the tree stand of FIG. 1.
Figure 13:
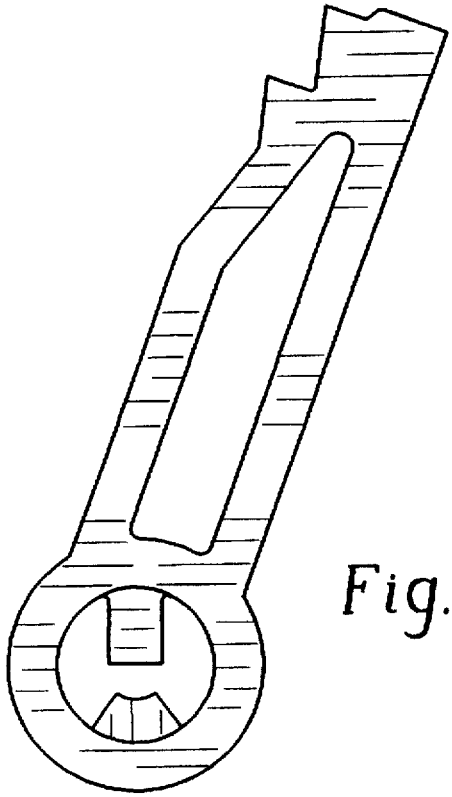
FIG. 13 is a plan view taken on line 13—13 of FIG. 12.
Figure 14:
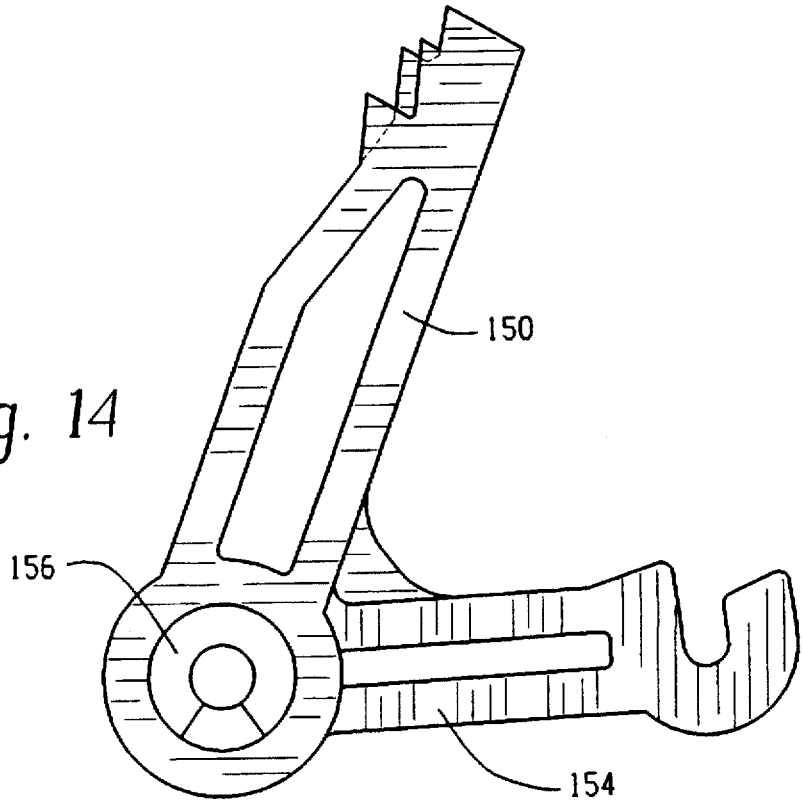
FIG. 14 is a plan view taken on line 14—14 of FIG. 12.
Figure 15:
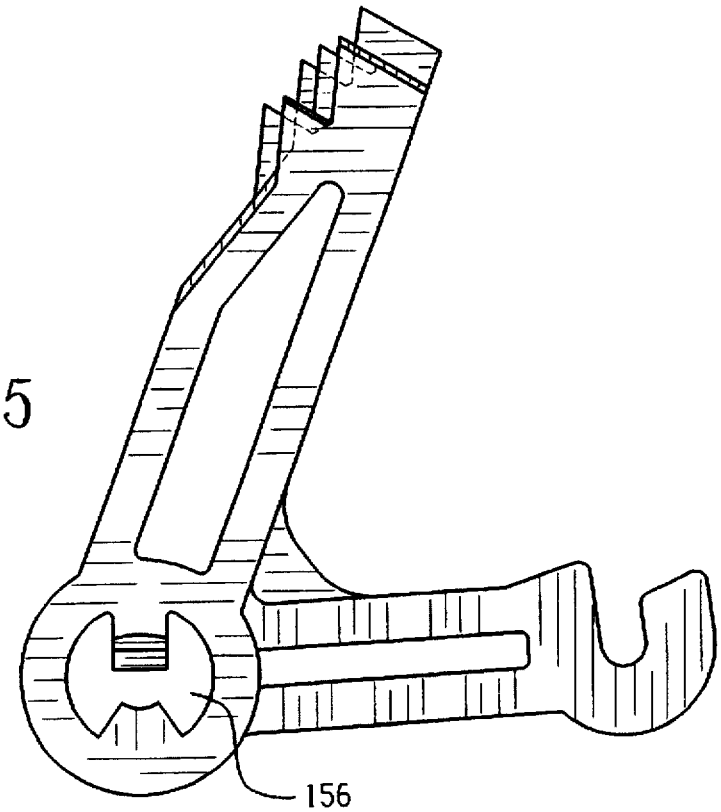
FIG. 15 is a plan view taken on line 15—15 of FIG. 12.
Figure 16:
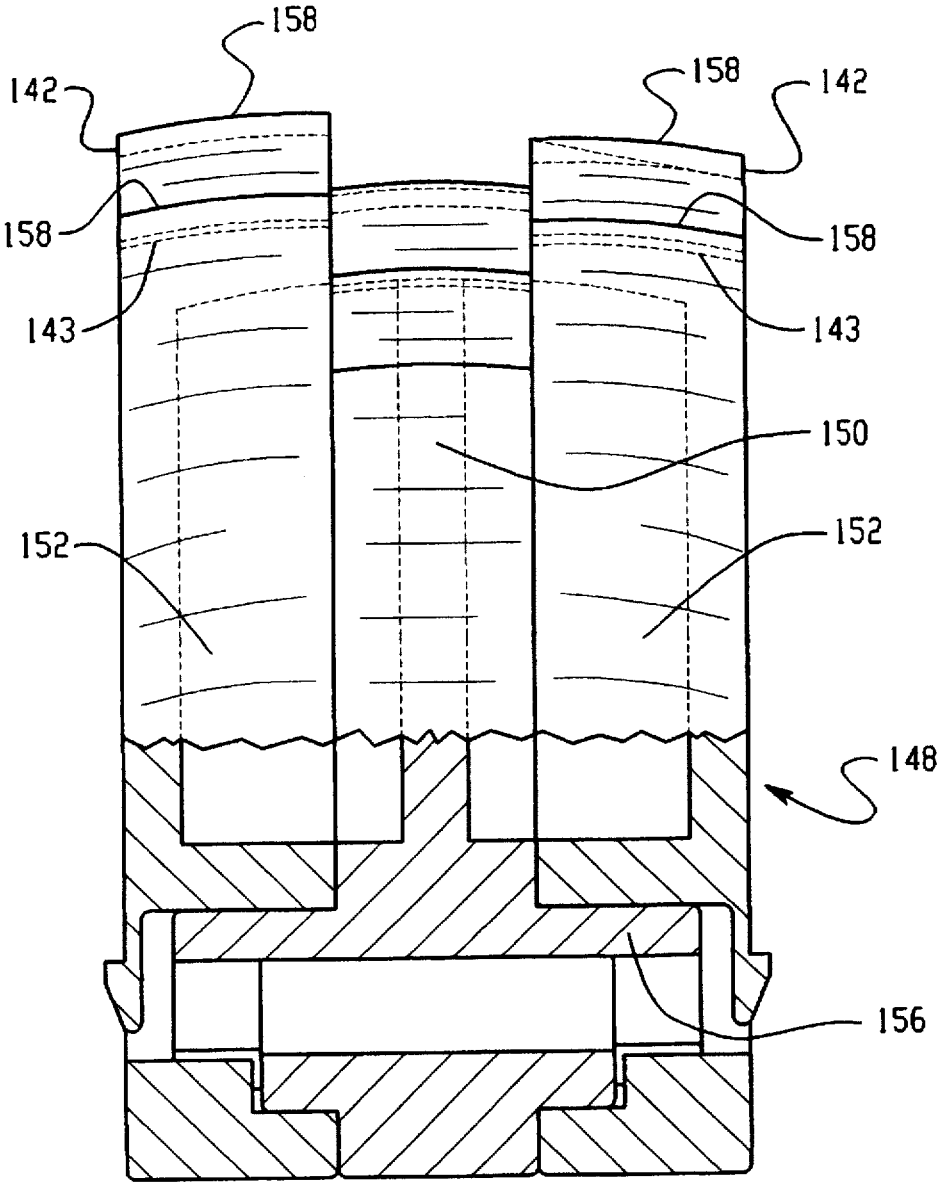
FIG. 16 is a bottom view of the preferred locking element of FIG. 12.

In a still further embodiment of the invention, one or more locking elements 96 is composed of a compound locking element as illustrated in FIGS. 12, 13, 14, 15 and 16. As illustrated in FIGS. 12 and 16, each compound locking element 148 is composed of a central actuating arm 150 and two side actuating arms 152, one on each side of central actuating arm 150. As shown in FIG. 14, central actuating arm 150 includes a connecting arm 154 similar to connecting arm 106 of locking element 96 in FIG. 5 for connection to locking arm 100 and foot pedal 102. Central actuating arm 150 also includes a central bushing 156 for rigidly mounting each of side actuating arms 152 so that all three actuating arms 152/150/152 move together. As shown in FIGS. 12 and 16, the outermost tips 158 of teeth 142 and 143 of compound locking element 148 project outwardly from central bushing 156 by a greater distance in the case of side actuating arms 152 than in the case of central actuating arm 150. Also, the leading edges of tips 158 on the teeth of side actuating arms 152 have a slanting profile such that the portions of the teeth closer to the central actuating arm protrude farther from bushing 156 than the portions of the teeth remote from the central actuating arm. It will also be noted from FIGS. 12 to 16, especially FIGS. 14, 15 and 16, that the outermost tips 158 on the teeth 142 and 143 of the three actuating arms 152/150/152 are staggered with respect to one another in terms of their distances from bushing 156.

When a locking element with only one actuating arm is used, upper shell 16 can be locked into place with respect to each locking element in discrete positions which are separated by intervals defined by the size of teeth 142 and 143 on the locking element. With the compound locking element of FIGS. 12 to 16, however, the size of these intervals can be reduced by a factor of three while the number of these discrete positions can be increased by a factor of three.

For example, in a particular embodiment of the invention, the teeth 142 and 143 on locking element 96 of FIG. 9 are located a distance apart corresponding to 1.5° of rotation of upper shell 16 with respect to lower shell 18. This means upper shell 16 can be locked in place with respect to lower shell 18 in 1.5° increments only. With compound locking element 148, however, this increment is cut to 0.5°. This is because each compound locking element presents three separate actuating arms whose teeth are staggered with respect to the teeth on the other actuating arms by increments corresponding to 0.5° of travel. In effect, this allows compound locking element 148 to present a locking arm which will exactly mate with the grooves in upper shell 16 every 0.5° of travel, rather than every 1.5° of travel. Therefore, compound locking element 148 increases by a factor of three the number of discreet positions at which upper shell 16 can be locked into place with respect to lower shell 18.

Furthermore, the slanting profiles of tips 158 on teeth 142 and 143 on side actuating arms 152 allow the compound locking element 148 to conform better to the curved configuration of grooves 70 as illustrated in FIG. 10B. This insures surface-to-surface contact of respective lock-bearing surfaces and grooves bearing surfaces, as described above, even if a side actuating arm 152 does the actual engagement with a groove 70. Moreover, in a particularly preferred embodiment, tips 158 on the teeth of all the locking arms exhibit a radial profile so that they conform exactly to the curved configuration of grooves 70.

Although only a few embodiments of the present invention have been described above, it should be appreciated that many modifications can be made without departing from the spirit and scope of the invention. For example, a locking element and associated grooves can be arranged on any horizontal axis of the base of the inventive stand rather than in the X and Y directions only. Also, different locking elements need not be arranged equally or symmetrically around base 12, if desired. Also, grooves 70 and teeth 142 and 143 can be reversed in portion, if desired. In other words, grooves 70 rather than being cut into the interior wall of spherical section 56 upper shell 16 can instead be formed from teeth extending outwardly from the wall. All such modifications are intended to be included within the scope of the present invention, which is to be limited only by the following claims:

I claim:

1. A tree stand for receiving and supporting a tree, said stand comprising a receptacle for receiving the trunk of said tree and a base for supporting said receptacle when said tree is received therein, said receptacle including a clamping assembly for securing said trunk in said receptacle, said base including (a) a top portion for receiving said receptacle, said top portion having a spherical surface defining at least one set of grooves therein, (b) a bottom portion for supporting said top portion, (c) a locking assembly movable between a locking position in which said top portion is prevented from moving with respect to said bottom portion and a disengaged position in which said top portion is permitted to swivel with respect to said bottom portion, said locking assembly including a locking element for engagement with a selected groove in said set of grooves depending on the position of said top portion with respect to said bottom portion, and (d) a universal joint preventing rotation of said top portion about the Z axis of said top portion, each of said grooves being configured to maintain surface-to-surface contact with said locking element regardless of the position of said top portion with respect to said bottom portion, and said top portion is adapted to pivot about a pivot point fixed in space with respect to said bottom portion, both said top portion and said bottom portion defining respective central axes, said bottom portion further defining orthagonally arranged X, Y and Z axes, said Z axis being aligned with the central axis of said bottom portion.

2. The tree stand of claim 1, wherein at least one of the grooves in said set of grooves is defined by the intersection of said spherical surface and a plane perpendicular to said X axis.

3. The tree stand of claim 2, wherein said grooves are configured such that each groove when selected for engagement with said locking element is defined by intersection.

4. The tree stand of claim 3, wherein each of said grooves is defined by a peak, a valley and a groove-bearing surface therebetween, said peak being defined by the intersection of said spherical surface and a first plane perpendicular to said X axis, said valley being defined by a the intersection of a second plane perpendicular to said X axis and a second sphere concentric with and large than said spherical surface.

5. The tree stand of claim 4, wherein said grooves are arranged in sets, the grooves in each set being arranged adjacent one another.

6. The tree stand of claim 5, wherein the inner surface of said top portion supports said set of grooves and a second set of grooves, each selected groove in said set of grooves lying on the intersection of said spherical surface and a plane arranged parallel to said X axis, each selected groove in said second set of grooves lying on the intersection of said spherical surface and a plane arranged parallel to said Y direction.

7. The tree stand of claim 6, wherein said locking element engages a selected groove in said set of grooves and a second locking element is provided for engaging a selected groove in said second set of grooves.

8. The tree stand of claim 7, wherein each of said locking elements includes a lock bearing-surface arranged for surface-to-surface contact with the groove-bearing surface of a selected groove in the associated set of grooves.

9. The tree stand of claim 8, wherein the peak and valley of each of said grooves is arranged so that the lock bearing surface of each locking element will always remain in surface-to-surface contact with the groove bearing surface of its respective selected groove when said locking means is in an engaged position regardless of the position of the upper portion of said base with respect to the lower portion of said base.

10. The tree stand of claim 1, wherein said locking element includes an actuating arm adapted on one end thereof to engage a selected groove, said actuating arm being pivotally mounted on the other end thereof on a pivotal axis for pivoting between said locking position and said disengaged position.

11. The tree stand of claim 10, wherein each of said grooves is defined by a peak, a valley and a groove-bearing surface therebetween, said locking element defining a lock-bearing surface for engagement with the groove-bearing surface of said selected groove.

12. The tree stand of claim 11, wherein the lock-bearing surface of said locking element is substantially arranged in a plane which is perpendicular to a line passing through said lock bearing surface and said pivotal axis.

13. The tree stand of claim 12, wherein each of said locking elements includes at least one actuating arm, each of said actuating arms defining at least two teeth for mating engagement with adjacent pairs of grooves.

14. The tree stand of claim 13, wherein said actuating arms carry said teeth on a distal end thereof and are pivotal about a pivotal axis on the other end thereof between a locking position in which said teeth engage said grooves for securing said top portion in place with respect to said bottom portion and a disengaged position in which said top portion is free to move with respect to said bottom portion.

15. The tree stand of claim 14, wherein each locking element includes said actuating arm and a second and third actuating arm, the teeth of each actuating arm being staggered with respect to the teeth on any other actuating arm in said locking element.

16. The tree stand of claim 15, wherein said actuating arm and second and third actuating arms define a central actuating arm and at least one side actuating arm adjacent thereto, the teeth in said side actuating arm having a slanting profile such that the portions of said teeth closer to said central actuating arm protrude farther from said pivotal axis than the portions of said teeth remote from said central actuating arm.

17. The tree stand of claim 1, wherein said receptacle comprises an annular sleeve substantially surrounding the trunk of the tree when received in said receptacle, a plurality of arms attached to said receptacle for securing the trunk within said receptacle, each of said arms having a first end and a second end, each of said second ends having a movable fastener secured thereto for allowing the respective first ends of said arms to be biased into secure engagement with the trunk after the trunk is place in said receptacle, and an accelerator member moveable with respect to said annular sleeve, said moveable fasteners engaging said accelerator member, said accelerator member being moveable between an open position for allowing said arms to be in a fully open position for receiving the trunk and an engaging position for bringing the first ends of said arms into approximate engagement with the trunk before said moveable fasteners are actuated to secure the trunk in said receptacle.

18. The tree stand of claim 17, wherein said accelerator member is an accelerator ring which is rotably moveable between said open and engaging positions.

19. The tree stand of claim 18, wherein said arms are hingedly attached to an upper portion of said receptacle so that the first ends thereof extend above said receptacle for engaging said tree trunk.

20. The tree stand of claim 19, wherein said receptacle includes a bottom section integral with said annular sleeve, said bottom section configured to matingly engage said base.

21. The tree stand of claim 20, wherein said bottom section is configured to be securely received in said base without the use of fasteners.

22. The tree stand of claim 21, wherein said bottom section is a cup-shaped member defining at least one opening therein for receiving water or other liquid in said base.

23. A tree stand for receiving and supporting a tree, said stand comprising a receptacle for receiving the trunk of said tree and a base for supporting said receptacle when said tree is received therein, said receptacle including a clamping assembly for securing said trunk in said receptacle, said base including (a) a top portion for receiving said receptacle, said top portion having a spherical surface defining at least one set of grooves therein, and having a central axis adapted to pivot about a pivot point fixed in space, (b) a bottom portion for supporting said top portion, said bottom portion defining orthagonally arranged X, Y and Z axes, said Z axis being aligned with said central axis of said bottom portion, (c) a locking assembly movable between a locking position in which said top portion is prevented from moving with respect to said bottom portion and a disengaged position in which said top portion is permitted to swivel with respect to said bottom portion, said locking assembly including a locking element for engagement with a selected groove in said set of grooves depending on the position of said top portion with respect to said bottom portion, and (d) a universal joint preventing rotation of said top portion about its central axis, said selected groove being defined by the intersection of said spherical surface and a plane perpendicular to said X axis.

24. The tree stand of claim 23, wherein each of said selected grooves is defined by a peak, a valley and a groove-bearing surface therebetween, said peak being defined by the intersection of said spherical surface and a first plane perpendicular to said x axis, said valley being defined by a the intersection of a second plane perpendicular to said x axis and a second sphere concentric with and larger than said spherical surface.

25. The tree stand of claim 24, wherein said set of grooves is arranged such that the grooves in said set are adjacent one another, and said locking assembly including said locking element associated with said set of grooves, such that said locking element is arranged to engage a selected groove in said set of grooves.

26. The tree stand of claim 25, wherein the inner surface of said top portion said set of grooves and a second set of grooves, each selected groove in said set of grooves lying on the intersection of said spherical surface and a plane arranged parallel to said X axis, each selected groove in said second set of grooves lying on the intersection of said spherical surface and a plane arranged parallel to said Y direction.

27. The tree stand of claim 26, wherein said locking element engages a selected groove in said set of grooves and a second locking element is provided for engaging a selected groove in said second set of grooves.

28. The tree stand of claim 27, wherein each of said locking elements includes a lock bearing-surface arranged for surface-to-surface contact with the groove-bearing surface of a selected groove in the associated set of grooves.

29. The tree stand of claim 28, wherein the peak and valley of each of said grooves is arranged so that the lock bearing surface of each locking element will always remain in surface-to-surface contact with the groove bearing surface of its respective selected groove when said locking means is in an engaged position regardless of the position of the upper portion of said base with respect to the lower portion of said base.

30. The tree stand of claim 23, wherein when said locking element includes an actuating arm adapted on one end thereof to engage a selected groove, said actuating arm being pivotally mounted on the other end thereof on a pivotal axis for pivoting said locking arm to said disengaged position.

31. A device comprising (a) an inner portion defining a central axis, said inner portion further defining orthagonally arranged X, Y and Z axes, said Z axis being aligned with said central axis, (b) an outer portion outside said inner portion and which defines a central axis, said outer portion being adapted to pivot about a pivot point fixed in space with respect to said inner portion, said outer portion having a spherical surface defining at least one set of grooves therein, (c) a locking assembly movable between a locking position in which said inner portion is prevented from moving with respect to said outer portion and a disengaged position in which said inner portion is permitted to move freely with respect to said outer portion, said locking assembly including a locking element for engagement with a selected groove in said set of grooves depending on the position of said top portion with respect to said bottom portion, said selected groove being defined by the intersection of said spherical surface and a plane perpendicular to said X axis, and (d) a universal joint preventing rotation of said outer portion about its central axis.

32. The device of claim 31, wherein said set of grooves is arranged such that the grooves in said set are adjacent one another.

33. The device of claim 32, wherein said locking assembly further includes a second locking element for engaging a selected groove in a second set of grooves.

34. The device of claim 33, wherein each of said selected grooves is defined by a peak, a valley and a groove-bearing surface therebetween, and further wherein each of said locking elements includes a lock bearing-surface arranged for surface-to-surface contact with the groove-bearing surface of its associated selected groove.

35. The device of claim 34, wherein the peak and valley of each of said grooves is arranged so that the lock bearing surface of each locking element will always remain in surface-to-surface contact with the groove bearing surface of its respective selected groove when said locking assembly is in an engaged position regardless of the position of the upper portion of said base with respect to the lower portion of said base.

* * * * *